US007302758B2

(12) United States Patent
Kaelin et al.

(10) Patent No.: US 7,302,758 B2
(45) Date of Patent: Dec. 4, 2007

(54) MANUFACTURING AND MOUNTING METHOD OF ELECTRICAL CONTACTS FOR CONTROL MEMBERS OF SMALL DIMENSIONS, IN PARTICULAR FOR THE HOROLOGICAL FIELD

(75) Inventors: Laurent Kaelin, Sonvilier (CH); Yannick Hunziker, Delémont (CH); Baptist Wyssbrod, Nidau (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 471 days.

(21) Appl. No.: 10/923,791

(22) Filed: Aug. 24, 2004

(65) Prior Publication Data

US 2005/0050718 A1 Mar. 10, 2005

(30) Foreign Application Priority Data

Sep. 9, 2003 (EP) ..... 03020320

(51) Int. Cl.
*G04G 1/02* (2006.01)
*H01H 11/00* (2006.01)
*H01H 25/06* (2006.01)

(52) U.S. Cl. ..... 29/876; 29/622; 29/874; 29/882; 29/884; 29/896.3; 29/896.34; 200/519; 200/538; 200/542; 368/187; 368/321

(58) Field of Classification Search ..... 29/622, 29/827, 874, 876, 877, 878, 879, 882, 884, 29/896.3, 896.34; 200/56 R, 61.29, 519, 200/537, 538, 542, 573, 238, 239, 240, 241, 200/410–423, 11 R–11 TW; 368/187, 190, 368/321

See application file for complete search history.

(56) References Cited

U.S. PATENT DOCUMENTS

| | | | | |
|---|---|---|---|---|
| 3,391,456 | A * | 7/1968 | Gannoe | 29/827 |
| 4,944,691 | A | 7/1990 | Marach | |
| 5,008,498 | A * | 4/1991 | Yamazaki | 200/11 R |
| 2002/0061686 | A1 | 5/2002 | Ma et al. | |

FOREIGN PATENT DOCUMENTS

| | | |
|---|---|---|
| DE | 36 11 224 A1 | 10/1987 |
| EP | 03011618.0 | 5/2003 |

* cited by examiner

*Primary Examiner*—A. Dexter Tugbang
*Assistant Examiner*—Livius R. Cazan
(74) *Attorney, Agent, or Firm*—Sughrue Mion Pllc.

(57) ABSTRACT

There is disclosed a method for manufacturing and mounting electric contacts for control members of small dimensions, particularly for control members used in the horological field. This method includes the following steps: a) stamping and pre-shaping a plate of electrically conductive material for forming an intermediate base plate including a support structure and a plurality of electric contact strips still mechanically connected to said support structure by a plurality of points of attachment, each electric contact strip including a base and a flexible extension connected to said base to form a mobile part of an electric contact that can be actuated by a control member, b) positioning the intermediate base plate on a first support piece electrically insulated from said electric contact strips, c) fixing onto said first support piece a second support piece electrically insulated from said electric contact strips such that each of said electric contact strips is held between said first and second support pieces via its base and d) breaking said plurality of points of attachment connecting the plurality of electric contact strips to said support structure such that all of the electric contact strips are made independent and electrically insulated from each other.

15 Claims, 9 Drawing Sheets

MANUFACTURING AND MOUNTING METHOD OF ELECTRICAL CONTACTS FOR CONTROL MEMBERS OF SMALL DIMENSIONS, IN PARTICULAR FOR THE HOROLOGICAL FIELD

This application claims priority from European Patent Application No 03020320.2 filed on Sep. 9, 2003, the entire disclosure of which is incorporated herein by reference.

FIELD OF THE INVENTION

The present invention relates to a method for manufacturing and mounting electric contacts for control members of small dimensions used in particular in the horological field. The present invention concerns in particular a method of this type for making a multi-function stem-crown for a timepiece or other similar electromechanical or electronic apparatus.

BACKGROUND OF THE INVENTION

Conventionally, the electric contacts of control members (for example push-buttons, stem-crowns, or suchlike) are designed in the form of a mobile part capable of being actuated by the control member for selectively establishing an electric connection with another part, generally fixed, of the electric contact. The mobile part of the electric contact is typically made in the form of a contact strip cut out of a plate of an electrically conductive material (generally a metal such as steel or copper) and bent into the desired shape. Each contact strip thereby formed is then mounted and fixed in proximity to the control member. This operation is for example carried out by hand or in accordance with automatic assembling methods essentially consisting in the contact strip being gripped by a manipulator (the contact strips being typically arranged loosely or in a strip in a feed device) and then mounted by the manipulator on its final support to which the contact strip is secured.

Provided that the contact strips are of reasonable size and their configuration is not too complex, the assembling operations do not generally raise any problems. This is not the case, however, when the contact strips are of very small size, making individual handling thereof difficult both by an operator and by a machine. Additional constraints are added to this, when a plurality of electric contact strips have to be mounted with a relatively high level of precision in relation to each other. This is particularly the case for the manufacture and mounting of electric contacts for multi-function control members. This concerns particularly multi-function stem-crowns whose rotations and axial positions are detected and converted by means of a plurality of electric contacts.

SUMMARY OF THE INVENTION

It is a general object of the present invention to propose a solution for more easily manufacturing and mounting the electric contacts of control members of small dimensions. It is a particular object of the present invention to simplify the manufacture and mounting of electric contacts for control members used in the horological field.

The present invention thus concerns a method for manufacturing and mounting electric contacts for control members of small dimensions whose features are listed in claim 1.

The method thus includes a first step of stamping and pre-shaping a plate of electrically conductive material to form an intermediate base plate including a support structure and a plurality of electric contact strips still mechanically connected to the support structure by a plurality of points of attachment, each electric contact strip including a base and a flexible extension connected to the base to form the mobile part of an electric contact that can be actuated by a control member. This first step is followed by a step of positioning the intermediate base plate on a first support piece electrically insulated from the electric contact strips, and by a step of fixing onto the first support piece a second support piece electrically insulated from the electric contacts strips such that each of the electric contact strips is held between the first and second support pieces via its base. Finally, there follows a step of breaking the plurality of points of attachment connecting the plurality of electric contact strips to the support structure such that all of the electric contact strips are rendered independent and electrically insulated from each other.

It will be understood that this method allows electric contact strips of small dimensions to be manufactured and mounted more simply. Indeed, when the electric contact strips are positioned and fixed, the latter are still connected to each other by the support structure. This support structure can thus be more easily handled with the electric contact strips. Moreover, the relative positioning precision of the various electric contact strips is ensured because of the fact that the contact strips are still connected to each other during the fixing step.

According to one embodiment, the aforementioned method is implemented particularly for making a multi-function stem-crown for a timepiece. According to this example, the stamping and pre-shaping step includes the preparation of a first set of electric contact strips for detecting rotations of the stem-crown and a second set of electric contact strips for detecting the axial positions of the stem-crown. Preferably, the stem-crown includes an electrically insulated end for actuating the electric contact strips, this end including a first part with a non-constant radius forming a cam for actuating the first set of electric contact strips and a second part including several cylindrical portions of different diameters for actuating the second set of electric contact strips.

Within the scope of the aforementioned embodiment, the first set of electric contact strips advantageously includes first and second electric contact strips placed on either side of the stem-crown, the flexible extensions of the first and second electric contact strips being oriented substantially perpendicularly to the axis of the stem-crown and axially shifted with respect to the stem-crown so as to be able to convert the rotations of the stem-crown into electric signals. Likewise, the second set of electric contact strips advantageously comprises first and second electric contact strips disposed either side of the stem-crown, the flexible extensions of first and second electric contact strips being oriented substantially parallel to the axis of the stem-crown and axially shifted with respect to the stem-crown so as to be able to convert axial positions of the stem-crown into electric signals.

Other advantageous embodiments form the subject of the dependent claims.

BRIEF DESCRIPTION OF THE DRAWINGS

Other features and advantages of the present invention will appear more clearly upon reading the following detailed description of implementations of the invention given solely by way of non-limiting example and illustrated by the drawings, in which.

DESCRIPTION OF IMPLEMENTATIONS OF THE INVENTION

The Figures illustrate a particular implementation example of the invention for making a multi-function stem-crown for a timepiece or other similar electromechanical or electronic apparatus. As will be seen in detail hereinafter, the invention may however be implemented within the scope of the manufacture and mounting of electric contacts for other types of control members, such as push-buttons or similar control members using one or more electric contacts for converting the movement or position of the control member. By way of example, the control member could be of a similar type to a joystick with two axes. It should thus be specified that the invention is not limited solely to making multi-function stem-crowns as described hereinafter. Moreover, although a particularly advantageous application of the invention is the manufacture of control members for timepieces, the invention could be applied in other fields, such as the manufacture of control members for portable electronic instruments (electronic pocket assistants, cellular telephones, etc.)

Figure 1A:
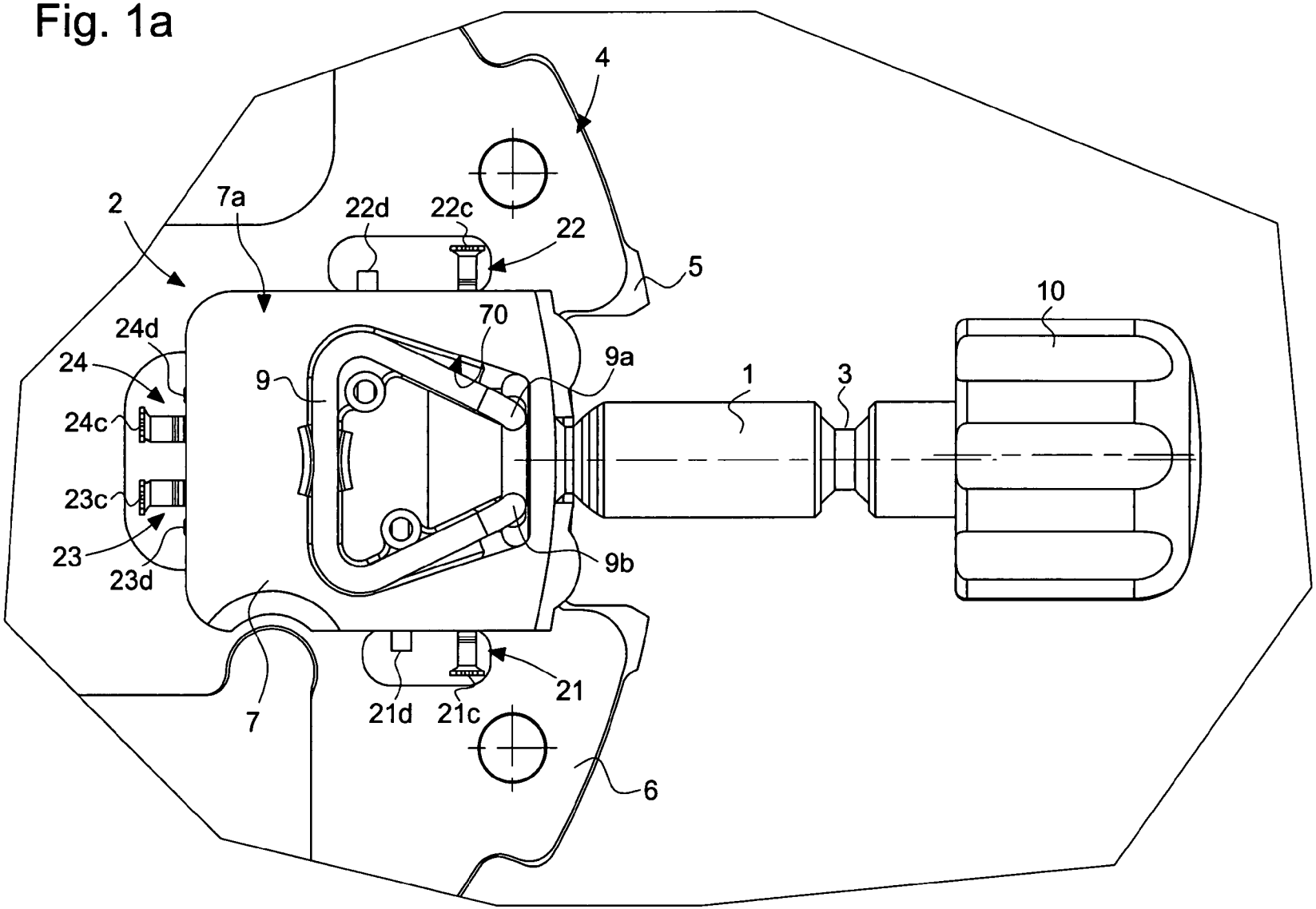
FIG. 1*a* is a plan view of the whole of a multi-function stem-crown including a set of four electric contacts manufactured and mounted in accordance with one implementation of the invention.

FIG. 1*a* is a plan view showing an overall view of a multi-function stem-crown. A "multi-function stem-crown" means here a control member including a stem (designated by the reference numeral 1 in the Figures) able to be handled by the user owing to a crown (designated by the reference numeral 10 in FIG. 1*a*) secured to stem 1 and whose rotational direction and/or axial positions are converted into electric signals owing to a plurality of electric contacts actuated by stem 1. These electric contacts are disposed and arranged in the form of a compact module designated as a whole by the reference numeral 2 placed at the end of stem 1 located opposite crown 10. Stem 1 further includes an annular groove 3 for receiving an O-ring joint (not shown) provided to ensure sealing between stem 1 and the case (not shown), which is penetrated by stem 1.

Figure 1B:
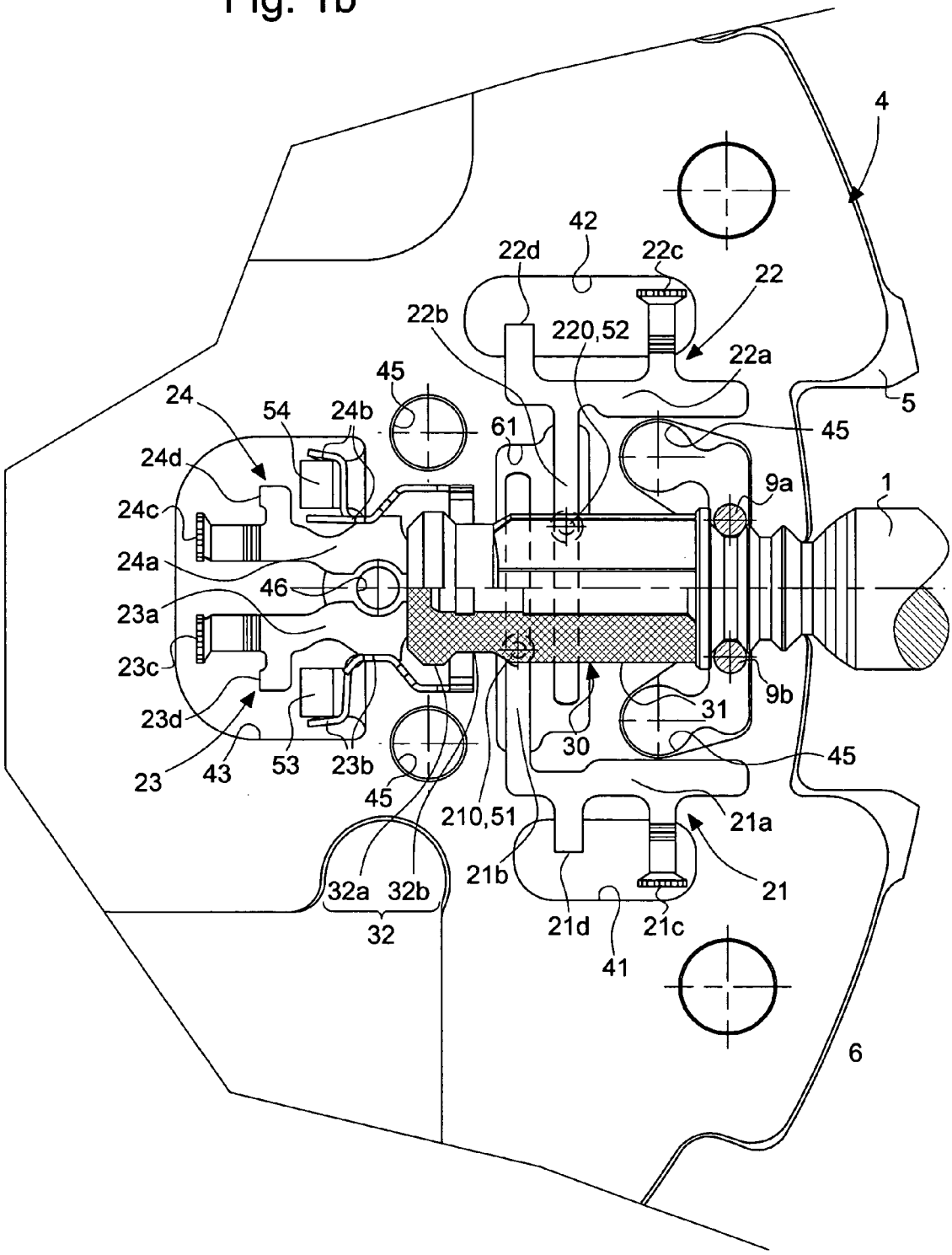
FIG. 1*b* is an enlarged plan view of FIG. 1*a* in which the elements masking the electric contacts have been removed in order to show the electric contact strips actuated by the stem-crown.

In the example illustrated, stem 1 is capable of occupying four distinct axial positions, namely a neutral position, two stable positions called the "pulled out" positions and an unstable position called "pushed in", and it can also be rotated clockwise and anti-clockwise. In FIGS. 1*a* and 1*b*, stem 1 is illustrated in its extreme pulled out position.

The four axial positions and the rotational direction of stem 1 are converted into electric signals owing to two independent sets of electric contacts. The first set of electric contacts includes two electric contact strips 21, 22 for converting the rotational direction of stem 1, each electric contact strip 21, 22 delivering an electric signal made up of an alternation of binary logic levels ("activated" or "inactivated" states) for making the distinction between the two rotational directions of stem 1. The second set of electric contacts includes two electric contact strips 23, 24 for converting the four axial positions of stem 1, each electric contact strip 23, 24 delivering an electric signal of the binary logic type, which is a function of the axial position of the stem.

The end of strip 1 and electric contact strips 21 to 24 are covered by a cap 7 made of an electrically insulating material (a part advantageously made by moulding of a plastic material) and which is secured to a support plate designated overall by the reference numeral 4. The top face 7*a* of cap 7 includes a recess 70 of a particular shape forming a housing for an open spring element 9. This spring element 9 has a particular bent shape, known in the prior art, suited to holding stem 1 in its three stable axial positions. This spring 9 is arranged in a conventional manner for cooperating with three adjacent annular grooves arranged on the body of stem 1 and separated by raised portions. These annular grooves and raised portions are not referenced but appear clearly in FIG. 1*a*. Spring 9 thus includes two free ends 9*a*, 9*b* (oriented substantially perpendicularly to the plane of the illustrations of FIGS. 1*a* and 1*b*), which extend inside module 2, on either side of stem 1. During an axial movement of stem 1, the free ends 9*a*, 9*b* of spring 9 move away from each other sliding on the raised portions before closing on one of the annular grooves of stem 1.

The aforementioned support plate 4 is made up here of two superposed parts. A first bottom part (or base plate) 5 is made of an electrically conductive material and is intended to be brought to a determined electric potential, for example the electric potential forming earth for an electronic module with which the control member has to cooperate. A second top part 6 is made of an electrically insulating material and is inserted between base plate 5 and the aforementioned various electric contact strips 21 to 24. In this regard, support plate 4 can be considered as a support piece electrically insulated from electric contact strips 21 to 24. This support piece 4 can of course take various forms.

The use of the aforementioned contact strips for interpreting the rotational direction and axial positions of a stem is already well known from the functional point of view. The configuration of electric contact strips 21 to 24 is, however, specific and in this respect forms the subject of two European Patent Applications in the name of the Applicant, respectively entitled "Dispositif de commande à positions axiales multiples pour appareil électronique" (EP Patent Application No. 02080681.6 filed 31 Dec. 2002) and "Dispositif de commande rotatif pour appareil électronique" (EP Patent Application No. 03011618.0 filed 22 May 2003). Only the elements and features linked to the subject of the present invention are recalled here.

FIG. 1*b* better shows the particular shape and configuration of electric contact strips 21 to 24. In this FIG. 1*b*, cap 7 and spring 9 have not been shown to allow the four contact strips 21 to 24 to be seen. Free ends 9*a*, 9*b* of the spring are, however, shown in cross-section in order to illustrate the arrangement thereof with respect to the annular grooves of stem 1.

From the foregoing, it will have been understood that the four electric contact strips 21 to 24 are inserted between support plate 4, on the one hand, and cap 7, on the other hand. In this case, each of the electric contact strips includes a part forming the base (designated by the reference number of the strip concerned followed by the letter "a") sandwiched between support plate 4 and cap 7.

Each of electric contact strips 21 to 24 further includes a first flexible extension (designated by the reference numeral of the strip concerned followed by the letter "b") connected to the base of the strip and which is capable of moving freely inside cap 7 via the action of stem 1. This first flexible extension of each electric contact strip forms the actual mobile part of each of the four electric contacts.

As can be observed in FIGS. 1*a* and 1*b*, each of electric contact strips 21 to 24 further includes an additional extension (designated by the reference numeral of the strip concerned followed by the letter "c"), which is accessible from the exterior of cap 7. Each of these additional extensions 21*c* to 24*c* forms the actual output terminal of each of the four electric contacts, i.e. a terminal at which an electric signal is delivered, representative of the state (closed/open) of the corresponding electric contact. These additional extensions 21*c* to 24*c* can advantageously have a "U"-shaped end (apparent particularly in FIGS. 2 and 3*b*) for the purpose of being inserted in corresponding metallised holes arranged in a printed circuit board (not shown) to which the control member has to be electrically connected.

In addition to bases 21*a* to 24*a*, flexible extensions 21*b* to 24*b* and output terminals 21*c* to 24*c*, electric contact strips 21 to 24 also have, in this example, terminations 21*d*, 22*d*, 23*d*, 24*d* respectively, opening out at the periphery of cap 7. These terminations 21*d* to 24*d* have no real use from the point of view of the electric operation of the four contacts. As will be seen hereinafter, these terminations are the result of the implementation of the electric contact manufacturing and mounting method according to the invention.

Prior to starting in detail the description of this manufacturing and mounting method, we will briefly explain how the four electric contacts are actuated by stem 1.

In the particular embodiment shown in the Figures, flexible extensions 21*b* to 24*b* of electric contact strips 21 to 24 are each arranged to be brought into contact with base plate 5 via the action of stem 1, in order to establish an electric connection with said base plate 5. As mentioned hereinbefore, while operating, the base plate is brought to a determined electric potential, for example an electric potential forming earth. When one of flexible extensions 21*b* to 24*b* is brought into contact with base plate 5, the electric potential of this base plate 5 is then brought onto the corresponding contact strip and this state can be detected at the output terminal 21*d*, 22*d*, 23*d*, 24*d* of the corresponding electric contact.

In the embodiment illustrated, at least the end of stem 1 which cooperates with the four electric contact strips 21 to 24 is electrically insulated, here by an insulating sheath 30, the body of stem 1 thus not being in direct electric contact with strips 21 to 24. This insulating sheath 30 includes a first part 31 of non-constant radius forming a cam (for example a part with a rectangular of elliptical section) for actuating the first set of electric contact strips 21, 22 and a second part 32 essentially including two cylindrical portions 32*a*, 32*b* of different diameters for actuating the second set of electric contact strips 23, 24.

The first 21 and second 22 electric contact strips of the first set are placed on either side of stem 1, flexible extensions 21*b*, 22*b* of these contact strips 21, 22 being oriented substantially perpendicularly to the axis of stem 1 and axially shifted with respect to stem 1 so as to be able to convert the rotations of the stem into electric signals. Extensions 21*b*, 22*b* are thus oriented in opposite directions. Extensions 21*b*, 22*b* are moreover bent at a point designated by the reference numeral 210, respectively 220 (cf, particularly FIGS. 2 and 3*b*) so as to be directed outside the plane where the strips are supported, in the direction of the axis of stem 1 (stem 1 resting at a certain distance above the electric contact strips). In this zone, support plate 4 has no insulation, an aperture 61 being arranged at this location in insulating layer 6 in order to expose a part of base plate 5. It will also be noted that two through orifices 41, 42 are arranged in support plate 4 (through base plate 5 and insulating layer 6) where ends 21*c*, 21*d* and 22*c*, 22*d* of strips 21, 22 are arranged.

Via the action of stem 1, in this case during a rotation of stem 1 about its axis, cam part 31 of sheath 30 successively actuates the two flexible extensions 21*b*, 22*b* of contact strips 21, 22, causing a slight downward movement of points 210, 220 where flexible extensions 21*b*, 22*b* are bent. These points 210, 220 are then brought into contact with base plate 5 through aperture 61 arranged in insulating layer 6. Preferably, two bosses 51, 52 are arranged facing points 210, 220 where extensions 21*b*, 22*b* are bent (these bosses 51, 52 are indicated in dotted lines in FIG. 1*b*).

The first 23 and second 24 electric contact strips of the second set are also placed on either side of stem 1, this time in proximity to the end of stem 1 and part 32 of sheath 30. In this example, flexible extensions 23*b*, 24*b* of these strips 23, 24 (at least the end parts of these extensions that cooperate with stem 1) are oriented substantially parallel to the axis of stem 1 and again axially shifted with respect to said stem 1 so as to be able to convert the axial positions of stem 1 into electric signals. A part of each flexible extension 23*b*, 24*b* is arranged for cooperating with the end 32 of sheath 30 placed on the stem, whereas another neighbouring part of each flexible extensions 23*b*, 24*b* is arranged for cooperating with a contact stud 53, respectively 54 integral with base plate 5. At this location, support plate 4 is again provided with a through orifice 43 into which extensions 23*c*, 23*d*, 24*c*, 24*d* of strips 23, 24 open out. Contact studs 53, 54 are made here in the form of extensions of base plate 5 bent through orifice 43 in the direction of stem 1. These contact studs 53, 54 are also visible in FIGS. 3*d* to 3*f*.

It should be noted that flexible extensions 23*b*, 24*b* are configured and pre-stressed to come into contact laterally with contact studs 53, 54 as illustrated in FIG. 1*b*. This contact is maintained provided that stem 1 is not brought into a position in which its end exerts an action to move the corresponding strip away. In the position illustrated (extreme pulled out position), the two strips 23, 24 are in contact with contact studs 53, 54. In the intermediate stable axial position (intermediate pulled out position), strip 23 is moved away from contact stud 53. In the last stable axial position (neutral position), the two strips 23, 24 are moved away from contact studs 53, 54. Finally in the unstable pushed in position (position accessible from the aforementioned neutral position), strip 23 temporarily comes into contact again with contact stud 53 to be moved away from it again after returning to the neutral position, this return being assured by the return force of spring 9.

We will not dwell any further on the description of the operation of the electric contacts, this operation not being directly connected to the claimed subject of the invention.

With reference to FIGS. 2 and 3*a* to 3*f*, we will now describe an implementation of the present invention for manufacturing and mounting electric contacts for the aforementioned multi-function stem-crown.

Generally, the proposed method proceeds as follows. This method starts first of all with the stamping and pre-shaping of a plate of electrically conductive material to form an intermediate base plate including a support structure and a plurality of electric contact strips still mechanically connected to support structure via a plurality of points of attachment (cf. FIG. 2), each electric contact strip comprising a base and a flexible extension connected to the base to form the mobile part of an electric contact that can be actuated by the control member. There then follows a step of positioning (cf. FIGS. 3*a* and 3*b*) the intermediate base plate on a first support piece electrically insulated from the contact strips, a step of fixing (cf. FIGS. 3*c*, 3*d* and 3*e*), onto the first support piece, a second support piece that is electrically insulated from the contact strips such that each of the electric contact strips is held between the first and second support pieces by its base, and finally a step of breaking (cf. FIG. 3*f*) the plurality of points of attachment connecting the plurality of electric contact strips to the support structure such that all of the electric contact strips are made independent and electrically insulated from each other.

Figure 2:
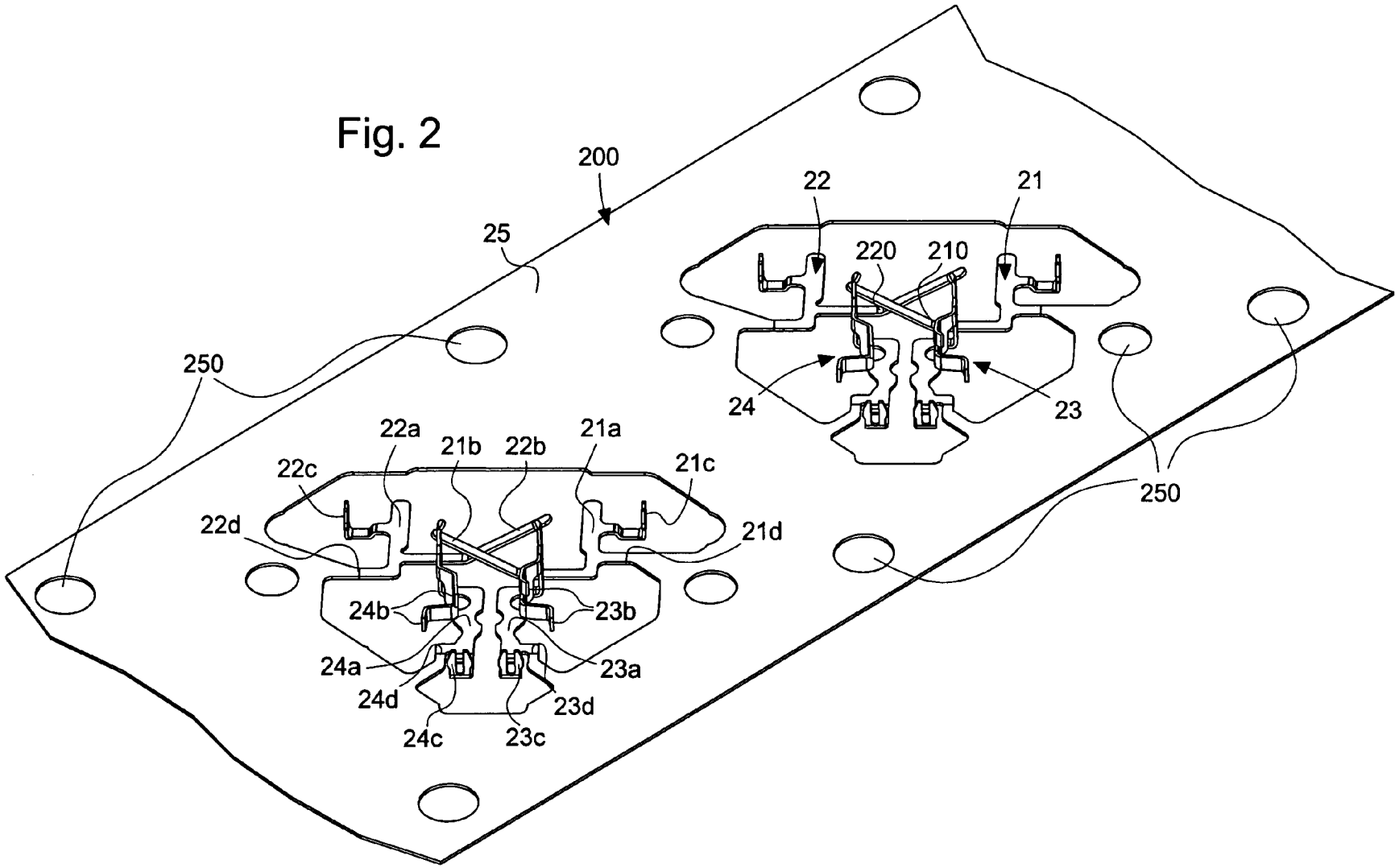
FIG. 2 is a perspective view of the electric contact strips of the multi-function stem-crown of FIG. 1, illustrated in a configuration prior to mounting in which they are still secured to a support structure advantageously in the form of a tape, this tape including several identical sets of electric contact strips.

The first stamping and pre-shaping step is preferably carried out so as to produce a tape including a plurality of identical sets of electric contact strips. This is the case in the implementation example which will now be described. FIG. 2 shows a tape 200 made of electrically conductive material (for example a metal of the steel or copper type), including several identical sets of strips 21 to 24 for making the electric contacts of the aforementioned stem-crown (several similar sets are thus made in tape 200, only two being illustrated in FIG. 2). This tape 200 is obtained in accordance with conventional stamping methods. Several orifices 250 are arranged in tape 200 to allow it to be handled and/or positioned. In the configuration illustrated in FIG. 2, it will thus be noted that each of electric contact strips 21 to 24 is mechanically connected to a support structure 25 to form tape 200, the aforementioned extensions 21*d* to 24*d* forming points of attachment between strips 21 to 24 and support structure 25.

Figure 3A:
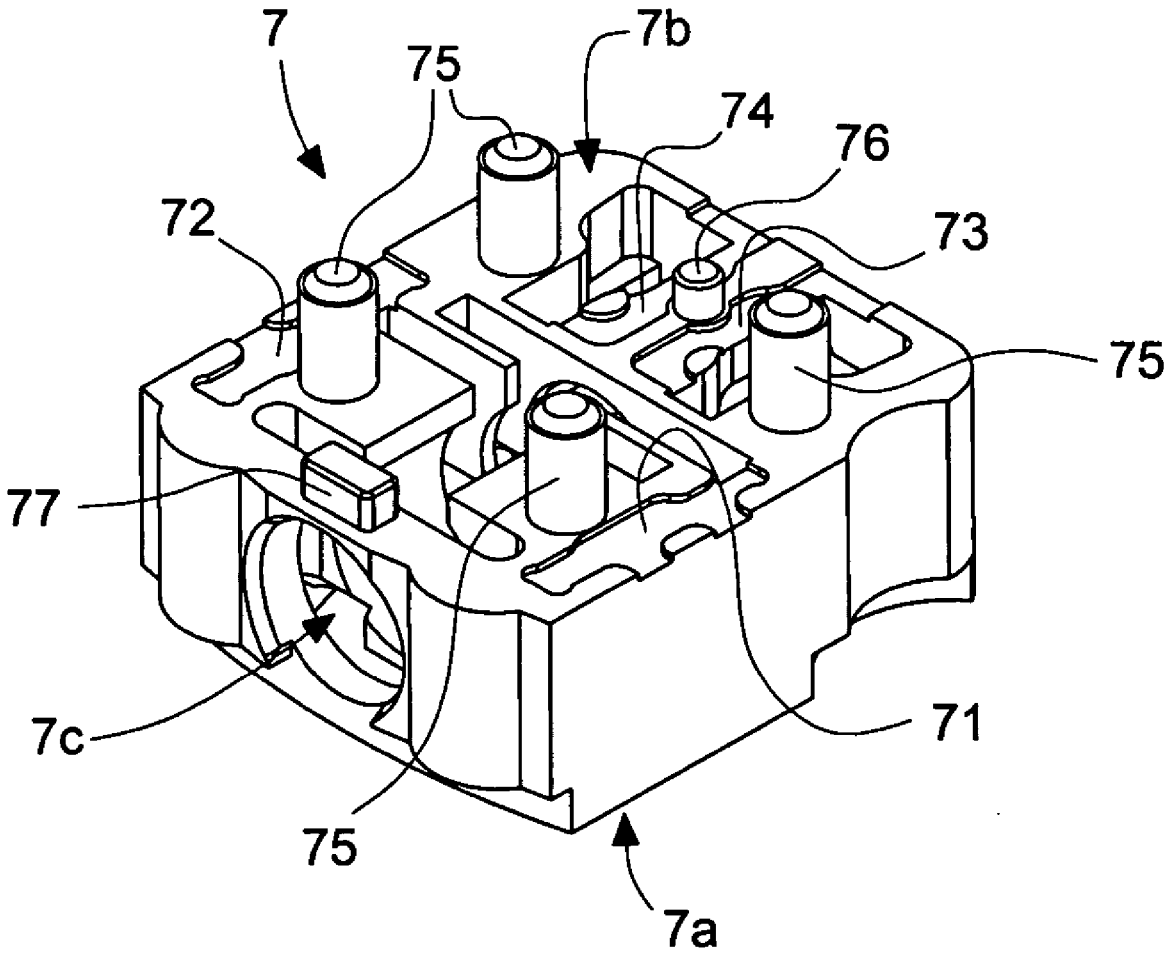
FIGS. 3*a* to 3*f* illustrate chronologically a succession of steps implemented for manufacturing and mounting electric contact strips for making the multi-function stem-crown of FIG. 1*a*.

FIG. 3*a* shows a perspective view of the aforementioned cap 7, this FIG. 3*a* showing the back face 7*b* of cap 7. In this view, orifice 7*c* can also be seen through which stem 1 is housed once mounted, as well as several mounting tenons 75, 76, 77. The four tenons 75 are for allowing cap 7 to be fixed onto support plate 4 through mounting orifices 45, as will be seen hereinafter, whereas tenons 76, 77 are for assuring suitable positioning of cap 7 on support plate 4. In this example, cap 7 also advantageously includes a set of stamps 71 to 74 corresponding to the general shape of bases 21*a* to 24*a* of the four electric contact strips 21 to 24. These stamps facilitate proper holding of the various strips when mounted. It will be noted that apertures (unreferenced) are also arranged for allowing the passage of flexible extensions 21*b* to 24*b* of electric contact strips 21 to 24 inside cap 7. It should be noted that the stamps could be made in either of the support pieces.

Figure 3B:
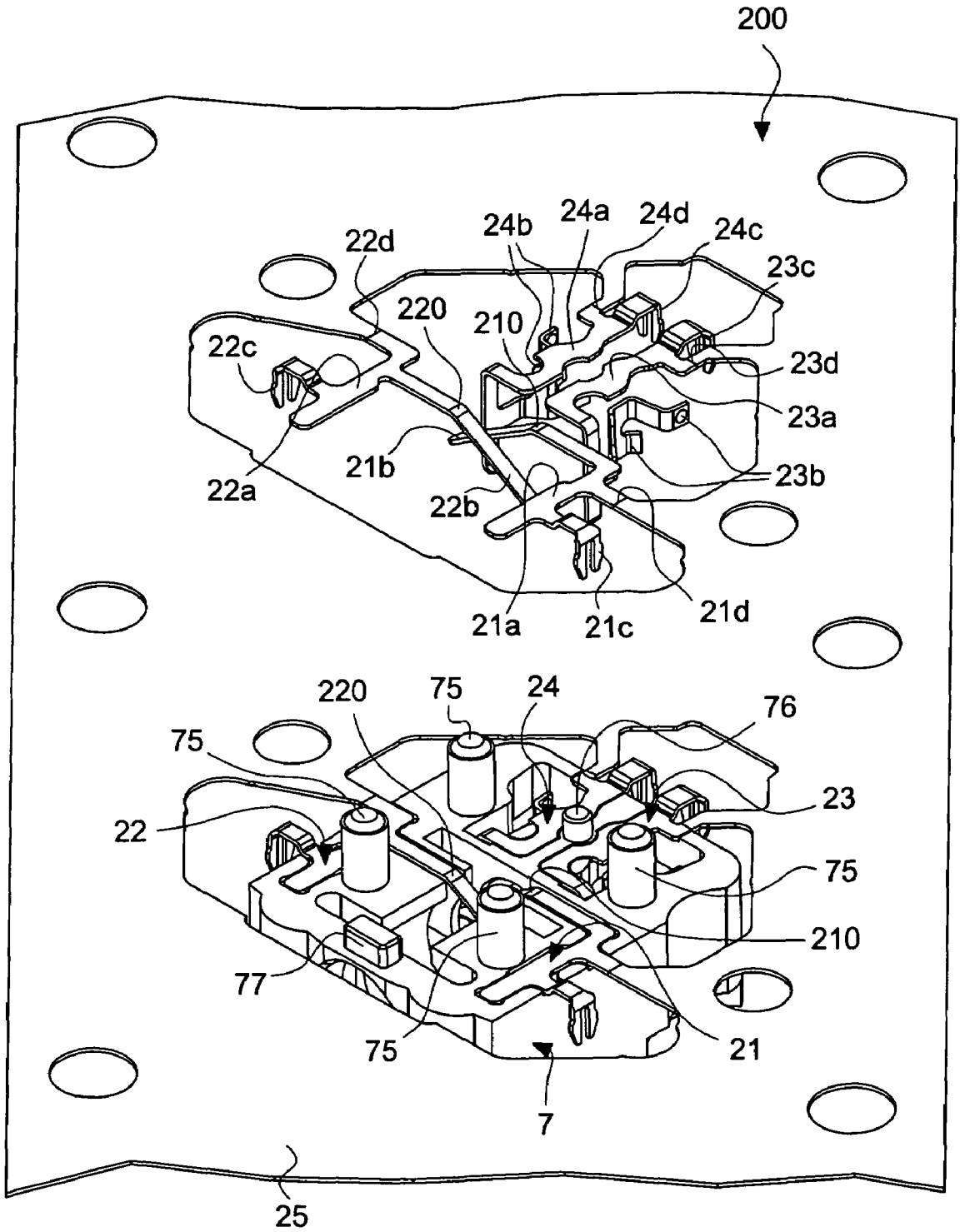

FIG. 3*b* shows a following step of the method in which tape 25 including strips 21 to 24 is positioned on cap 7. Bases 21*b* to 24*b* can thus be seen embedded in the corresponding stamps 71 to 74.

Figure 3C:
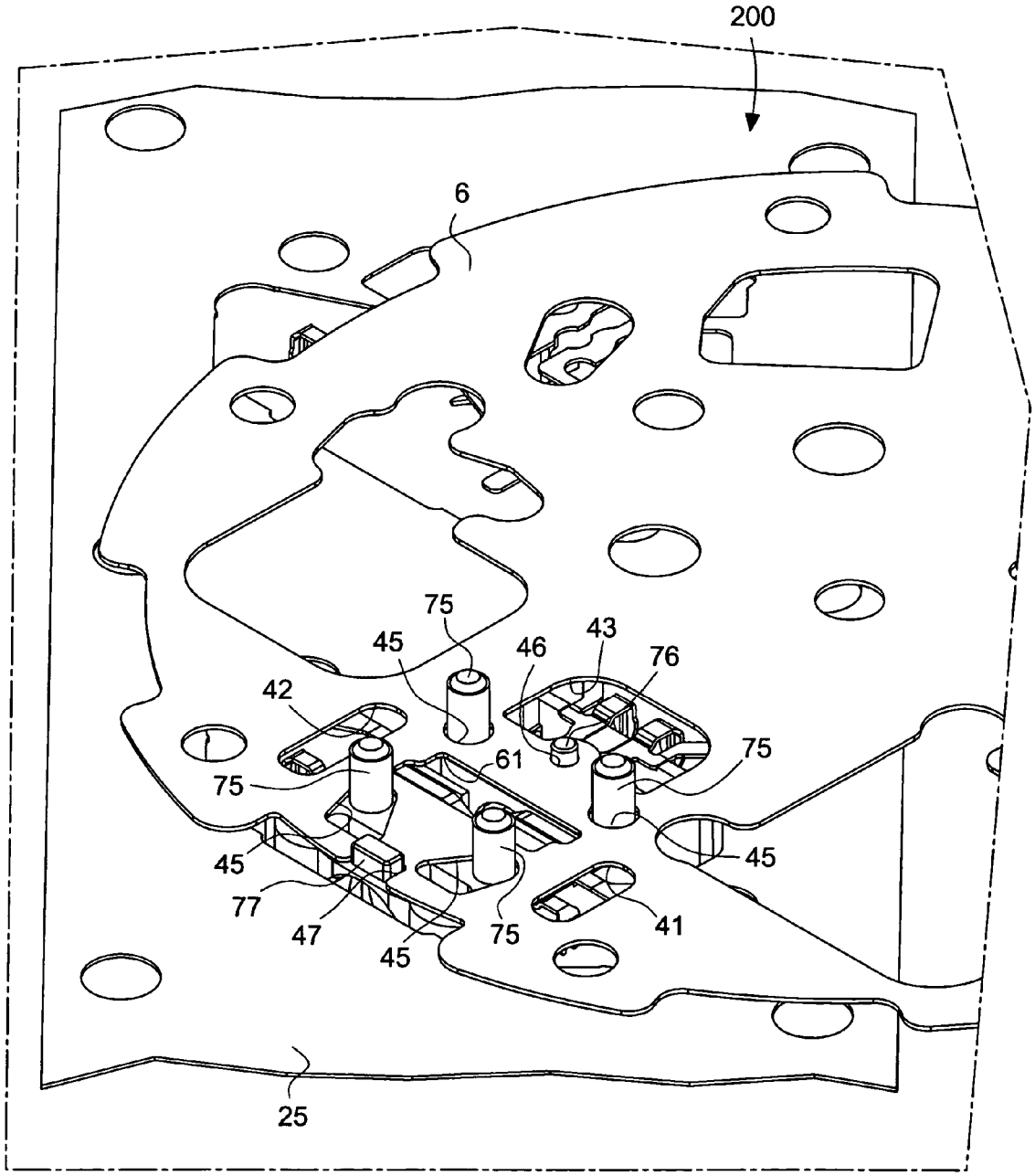
Figure 3D:
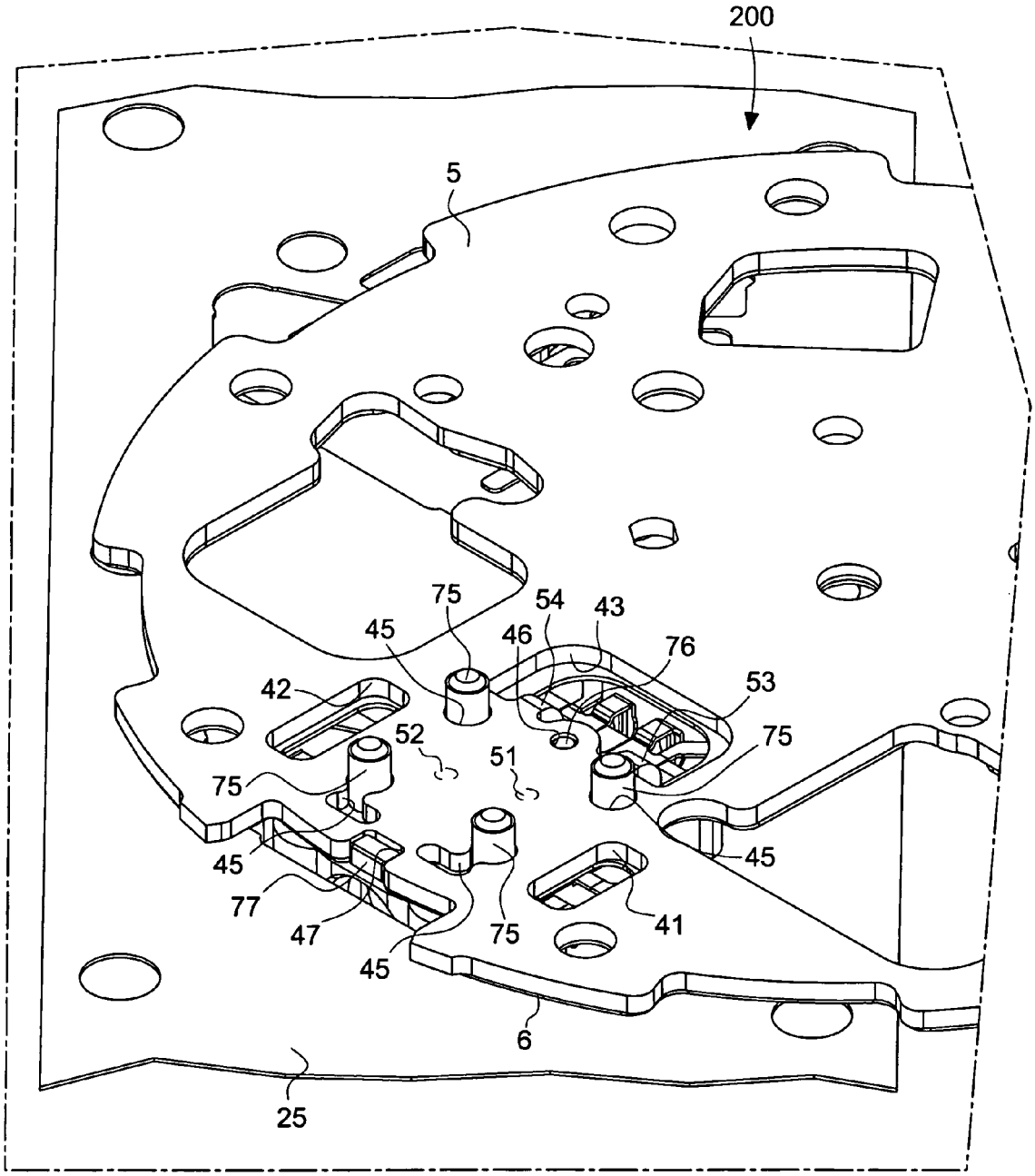

After strips 21 to 24 have been positioned on cap 7, insulating layer 6 and base plate 5 are then positioned on the tape to form support plate 4 (FIGS. 3*c* and 3*d*). After mounting in base plate 5, it will thus be noted that tenons 75, 76, 77 of cap 7 are housed in the corresponding mounting orifices 45, 46, 47 and that apertures 41, 42, 43 arranged in support plate 4 allow access to points of attachment 21*d* to 24*d* of electric contact strips 21 to 24.

Figure 3E:
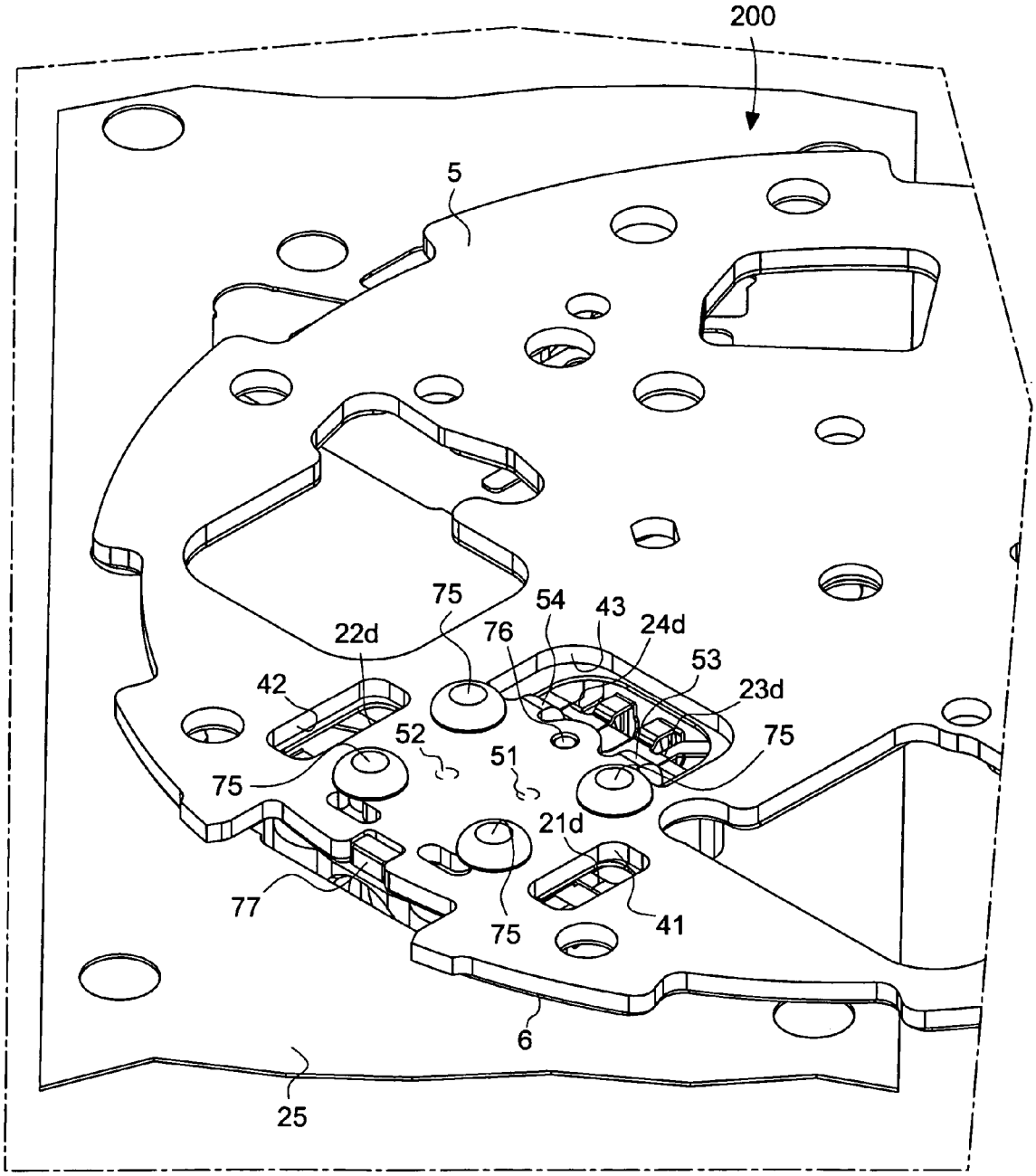

As illustrated in FIG. 3*e*, the ends 75 of the tenons are then plastically deformed in order to secure cap 7 to support plate 4 and to hold the various contact strips 21 to 24. It will be understood that cap 7 could be secured to support plate 4 by other means (for example welding, bonding, snap fitting, screwing, etc.).

Figure 3F:
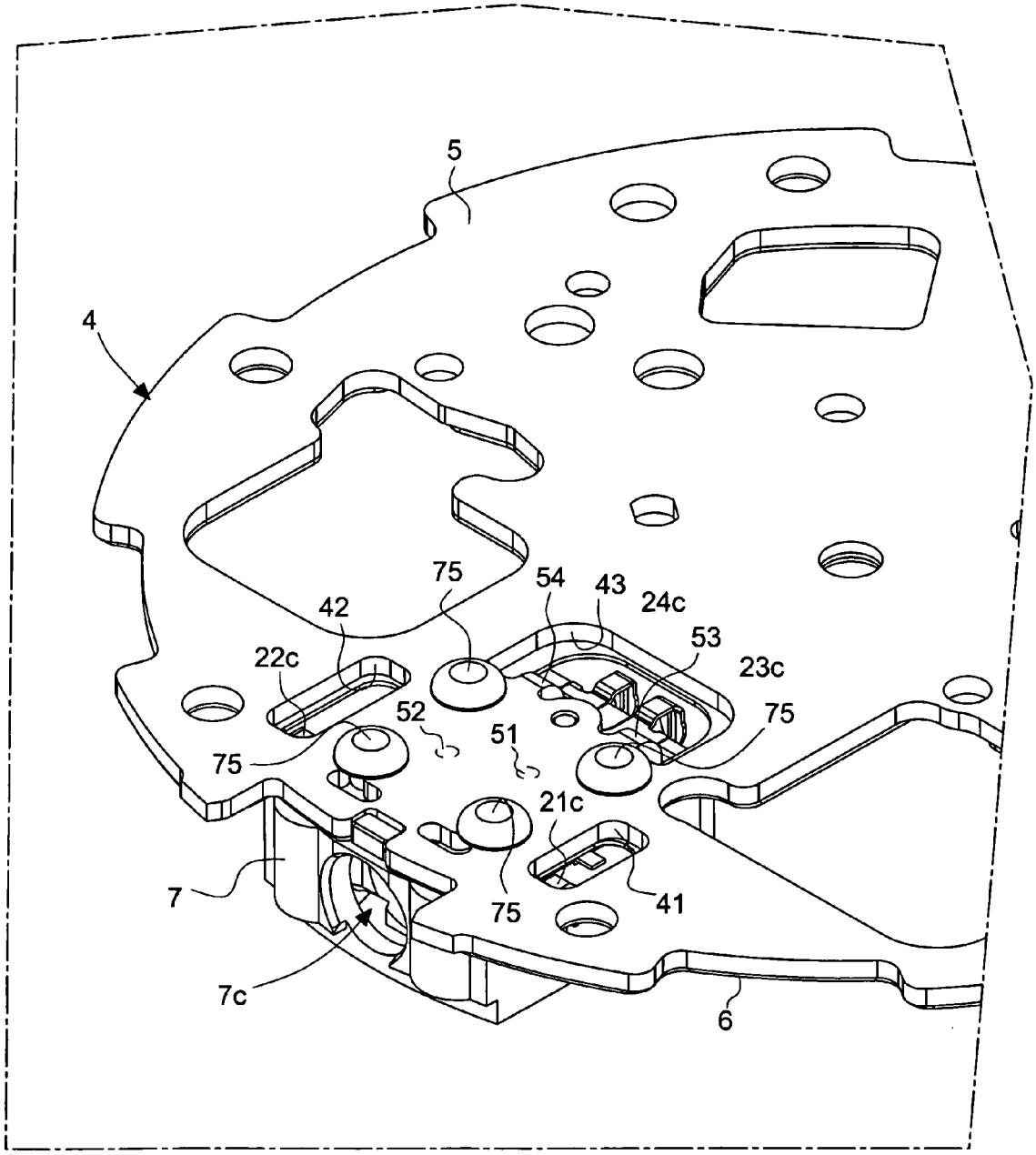

As illustrated in FIG. 3*f*, electric contact strips 21 to 24 can then be detached from support structure 25 to be made independent and electrically insulated from each other. In the example, this is advantageously achieved by using a tool (not shown) to break the various points of attachment 21*d* to 24*d* of the strips through orifices 41, 42, 43 provided for facilitating this operation. In order to ensure easy breakage of the points of attachment, the section of the contact strips can be reduced locally to facilitate the cutting of the strip along a determined line.

The various electric contacts of the control member are thus made. All that remains is the mounting of the actual control member itself (in this case stem 1 provided with its crown 10 and axial positioning spring 9 for stem 1) and formation of the electric contacts between the output terminals of the electric contacts and the appropriate electronic module. In the present case, it will be noted that stem 1 and crown 10 are typically only mounted at a later stage of manufacture, in this case after the mounting the movement of the timepiece and insertion into its case.

It will be understood generally that various modifications and/or improvements that are evident to those skilled in the art can be made to the embodiments described in the present description without departing from the scope of the invention defined by the annexed claims. As already mentioned in the preamble, the invention is not limited to making electric contacts for multi-function stem-crowns but can be applied by analogy to the manufacture of any electric contact for a control member of small dimensions, for example for push-buttons or control members of a similar type to a joystick. It will also be understood that the method could be used for manufacturing and assembling simultaneously the electric contact or contacts of several control members.

What is claimed is:

1. A method for manufacturing and mounting electric contacts for control members of small dimensions, particularly for control members used in the horological field, wherein the method includes the following steps:

a) stamping and pre-shaping a plate of electrically conductive material for forming an intermediate base plate including a support structure and a plurality of electric contact strips still mechanically connected to said support structure by a plurality of points of attachment, each electric contact strip including a base and a flexible extension connected to said base to form a mobile part of an electric contact adapted to be actuated by a control member;

b) positioning the intermediate base plate on a first support piece electrically insulated from said electric contact strips;

c) fixing onto said first support piece a second support piece including a base made of an electrically conductive material covered with an insulating material such that each of said electric contact strips is held between said first support piece and said insulating material of said second support piece via its base, said base being adapted to be brought to an electric potential to act as a contact zone common to all of said electric contact strips and with which each of the flexible extensions of said electric contact strips is adapted to be brought into contact to establish an electric connection when actuated by the control member; and d) breaking said plurality of points of attachment connecting the plurality of electric contact strips to said support structure such that all of the electric contact strips are made independent and electrically insulated from each other, wherein said first or second support piece includes a base plate and an insulating layer through which through orifices are arranged to allow access to said plurality of points of attachment of said electrical contact strips for facilitating breakage of said plurality of points of attachment using a tool.

2. The method according to claim 1, wherein said step of fixing the second support piece onto the first support piece includes, in particular, welding, bonding, snap-fitting, screwing or riveting said first and second support pieces.

3. The method according to claim 2, wherein said stamping and pre-shaping step includes the preparation of a tape including a plurality of identical sets of electric contact strips.

4. The method according to claim 1, wherein step a) further includes an operation of forming an additional extension forming an output terminal for each of said electric contact strips.

5. The method according to claim 4, wherein said stamping and pre-shaping step includes the preparation of a tape including a plurality of identical sets of electric contact strips.

6. The method according to claim 1, wherein said first or second support piece includes a plurality of stamps into which said bases of the electric contact strips are embedded during the fixing step.

7. The method according to claim 6, wherein said stamping and pre-shaping step includes the preparation of a tape including a plurality of identical sets of electric contact strips.

8. The method according to claim 1, wherein the section of said electric contact strips is reduced locally in proximity to the points of attachment to facilitate the cutting of the electric contact strips during the breaking step.

9. The method according to claim 8, wherein said stamping and pre-shaping step includes the preparation of a tape including a plurality of identical sets of electric contact strips.

10. The method according to claim 1, wherein said stamping and pre-shaping step includes the preparation of a tape including a plurality of identical sets of electric contact strips.

11. The method according to claim 1, wherein said stamping and pre-shaping step includes the preparation of a tape of electrically conductive material to form the intermediate base plate including the support structure and a plurality of identical sets of electric contact strips still mechanically connected to said support structure via a plurality of points of attachment.

12. A method for manufacturing and mounting electric contacts for control members of small dimensions, particularly for control members used in the horological field, wherein the method includes the following steps:

a) stamping and pre-shaping a plate of electrically conductive material for forming an intermediate base plate including a support structure and a plurality of electric contact strips still mechanically connected to said support structure by a plurality of points of attachment, each electric contact strip including a base and a flexible extension connected to said base to form a mobile part of an electric contact adapted to be actuated by a control member;

b) positioning the intermediate base plate on a first support piece electrically insulated from said electric contact strips;

c) fixing onto said first support piece a second support piece including a base made of an electrically conductive material covered with an insulating material such that each of said electric contact strips is held between said first support piece and said insulating material of said second support piece via its base, said base being adapted to be brought to an electric potential to act as a contact zone common to all of said electric contact strips and with which each of the flexible extensions of said electric contact strips is adapted to be brought into contact to establish an electric connection when actuated by the control member; and d) breaking said plurality of points of attachment connecting the plurality of electric contact strips to said support structure such that all of the electric contact strips are made independent and electrically insulated from each other, wherein said stamping and pre-shaping step includes the preparation of a first set of electric contact strips for detecting rotations of a multi-function stem-crown and a second set of electric contact strips for detecting axial positions of said stem-crown.

13. The method according to claim 12, wherein said stem-crown includes an electrically insulated end for actuating said electric contact strips, said end including a first part of non-constant radius forming a cam for actuating said first set of electric contact strips and a second part including several cylindrical portions of different diameters for actuating said second set of electric contact strips.

14. The method according to claim 13, wherein said first set of electric contact strips includes first and second electric contact strips placed on either side of the stem-crown, the flexible extensions of said first and second electric contact strips being oriented substantially perpendicularly to the axis of the stem-crown and axially shifled with respect to the stem-crown so as to be able to convert the rotations of said stem-crown into electric signals, and in that said second set of electric contact strips includes third and fourth electric contact strips placed on either side of the stem-crown, the flexible extensions of said third and fourth electric contact strips being oriented substantially parallel to the axis of the stem-crown and axially shifled with respect to the stem-crown so as to be able to convert the axial positions of said stem-crown into electric signals.

15. A method for manufacturing and mounting electric contacts for control members of small dimensions, particularly for control members used in the horological field, wherein the method includes the following steps:

a) stamping and pre-shaping a plate of electrically conductive material for forming an intermediate base plate including a support structure and a plurality of electric contact strips still mechanically connected to said support structure by a plurality of points of attachment, each electric contact strip including a base and a flexible extension connected to said base to form a mobile part of an electric contact adapted to be actuated by a control member;

b) positioning the intermediate base plate on a first support piece electrically insulated from said electric contact strips;

c) fixing onto said first support piece a second support piece including a base made of an electrically conductive material covered with an insulating material such that each of said electric contact strips is held between said first support piece and said insulating material of said second support piece via its base, said base being adapted to be brought to an electric potential to act as a contact zone common to all of said electric contact strips and with which each of the flexible extensions of said electric contact strips is adapted to be brought into contact to establish an electric connection when actuated by the control member; and d) breaking said plurality of points of attachment connecting the plurality of electric contact strips to said support structure such that all of the electric contact strips are made independent and electrically insulated from each other, wherein said first or second support piece includes a base plate and an insulating layer through which through orifices are arranged to allow access to said plurality of points of attachment of said electrical contact strips for facilitating breakage of said plurality of points of attachment using a tool, and wherein said stamping and pre-shaping step includes the preparation of a first set of electric contact strips oriented substantially perpendicularly to the axis of a multi-function stem-crown for a timepiece, for detecting rotations of said stem-crown and a second set of electric contact strips, oriented substantially parallel to the axis of the stem-crown, for detecting axial positions of said stem-crown.

* * * * *